US006113361A

United States Patent [19]

Djordjevic

[11] Patent Number: 6,113,361

[45] Date of Patent: Sep. 5, 2000

[54] INTENSIFIED HIGH-PRESSURE COMMON-RAIL SUPPLY PUMP

[75] Inventor: Ilija Djordjevic, East Granby, Conn.

[73] Assignee: Stanadyne Automotive Corp., Windsor, Conn.

[21] Appl. No.: 09/243,044

[22] Filed: Feb. 2, 1999

[51] Int. Cl.[7] ..... F04B 9/08; F04B 35/02

[52] U.S. Cl. ..... 417/383; 417/385; 123/456

[58] Field of Search ..... 60/520; 417/387, 417/383, 388, 216, 385, 386, 254, 273, 53; 123/456, 467, 25 R, 527

[56] References Cited

U.S. PATENT DOCUMENTS

| | | | |
|---|---|---|---|
| 4,215,548 | 8/1980 | Beremand | 60/520 |
| 4,304,531 | 12/1981 | Fisher | 417/388 |
| 4,459,089 | 7/1984 | Vincent et al | 417/383 |
| 4,536,135 | 8/1985 | Olsen et al. | 417/383 |
| 4,711,616 | 12/1987 | Tsukahara et al. | 417/216 |
| 4,948,349 | 8/1990 | Koiwa et al. | 417/383 |
| 5,032,064 | 7/1991 | Eickmann | 417/386 |
| 5,109,822 | 5/1992 | Martin | 123/456 |
| 5,638,791 | 6/1997 | Tsuzuki et al. | 123/467 |
| 5,669,334 | 9/1997 | Schonfeld et al. | 123/25 R |
| 5,678,524 | 10/1997 | Ofner et al. | 123/527 |
| 5,685,275 | 11/1997 | Djordjevic | 123/467 |
| 5,688,110 | 11/1997 | Djordjevic | 417/254 |
| 5,769,611 | 6/1998 | Djordjevic | 417/273 |
| 5,810,567 | 9/1998 | Horn | 417/387 |
| 5,888,054 | 3/1999 | Djordjevic | 417/254 |
| 5,941,214 | 8/1999 | Hoffmann et al. | 123/456 |
| 5,975,864 | 11/1999 | De Santis et al. | 417/273 |
| 6,027,312 | 2/2000 | Djordjevic | 417/53 |

*Primary Examiner*—Mark Paschall
*Assistant Examiner*—Leonid Fastovsky
*Attorney, Agent, or Firm*—Alix, Yale & Ristas, LLP

[57] ABSTRACT

A fuel pump, a fuel-pressure intensifier sub-assembly and a method of producing intensified high-pressure fuel are disclosed. The pump has a metered fuel circuit, a plurality of low-pressure bores with low-pressure plungers disposed therein, an intensifier bore with a piston disposed therein, a resilient bias member acting on the piston, a high-pressure bore with a high-pressure plunger at least partially disposed therein and a fuel outlet port. The pump operates in alternating fuel-in-take and fuel-pumping phases of operation under the influence of a rotary drive shaft with a cam and cooperating cam followers. By selecting the pumping surface areas of the low-pressure plungers and the high-pressure plunger, it is possible to select the fuel-pressure generated by the fuel pump. This pressure differs from the pressure generated by the low-pressure pumping plungers alone by an amount which is equal to the ratio of the aggregate surface area of the low-pressure pumping plungers to the surface area of the high-pressure pumping plunger.

20 Claims, 6 Drawing Sheets

INTENSIFIED HIGH-PRESSURE COMMON-RAIL SUPPLY PUMP

BACKGROUND OF THE INVENTION

1. Field of the Invention

The present invention generally relates to the field of high-pressure fuel pumps for use with internal combustion engines. More particularly, the present invention is directed to common-rail fuel pumps of the type having reciprocating plungers for periodically delivering fuel at high pressure to an accumulator for fuel injection. Accordingly, the general objects of the present invention are to provide novel and improved methods and apparatus of such character.

2. Description of the Related Art

Fuel pumps for use with fuel injected internal combustion engines are widely known in the art. While the earliest of such pumps delivered charges of fuel directly to a plurality of fuel injectors, more recent developments have focused on common-rail fuel-delivery systems which operate at higher fuel pressures. One such common-rail fuel pump is disclosed in co-pending U.S. patent application Ser. No. 08/883,448 which was filed on Jun. 26, 1997. The contents of this application are hereby incorporated by reference to provide additional details regarding high-pressure fuel pumps and their associated fuel injection systems.

Related art fuel pumps such as those disclosed in the incorporated application are typically designed to operate at fuel pressures of about 1,000 bar or less. While such pumps presently operate quite effectively, they are likely to become deficient in the future as governmentally imposed emission control standards become more demanding. This is because, in order to meet the stricter emission standards expected in the future, internal combustion engine manufacturers have been requiring higher and higher fuel pressures from fuel pumps used therewith. Thus, while state of the art fuel pumps produce fuel pressures up to about 1,000 bar, it is expected that fuel pressures above about 2,000 bar will become commonplace in the near future.

This increase in fuel-pressure may be achieved by either modifying conventional pumps or by developing new pump designs. For example, it may be possible to modify the various components of related art high-pressure fuel pumps in order to increase the pressure of the fuel pumped from such conventional pumps. However, fuel pumps of the related art inherently possess a number of limitations which severely limit the amount by which fuel-pressure can be increased. For example, the pressure of fuel pumped from related art fuel pumps can be increased to a small extent merely by reducing the diameter of the pumping plungers used therein (e.g., from about 0.270 inches to about 0.210 inches). Such a modification can be expected to increase the fuel-pressure of the related art pumps from a maximum of about 1,000 bar to a maximum of about 2,000 bar.

Further decreases in the diameter of the pumping plungers, however, are simply neither practical nor economical for a number of reasons. For example, the cost of manufacturing pumps increases radically as the size of the pumping plungers decreases. Moreover, fuel leakage losses increase as the size of the pumping plungers decreases because as plunger size decreases more plungers are necessary to maintain a given displacement. Other problems result from the low lubricity of some fuels, such as diesel fuel, and because of the high Hertzian stresses typically encountered within such pumps.

Another limitation associated with achieving fuel pressures in excess of 2,000 bar relates to the need for expensive high-pressure seals to seal the various components of such a pump. Generally speaking, redesigning existing fuel pumps to achieve still higher fuel pressures may lead to severe fuel leakage due to the size of various components and to the limitations of existing seals. This problem can be reduced by using higher quality seals throughout the pump. However, this is an expensive solution, especially if the use of high quality seals can be avoided altogether.

Accordingly, there remains a need in the art for a high-pressure fuel pump for use with internal combustion engines which is capable of delivering fuel at pressures in excess of 2,000 bar. Naturally, an ideal fuel pump capable of delivering such high fuel pressures will need to be both reliable and cost effective.

There is a further need in the art for improved methods of supplying high-pressure fuel to internal combustion engines which will reliably and inexpensively meet or exceed the fuel-pressure demands expected in the near future.

SUMMARY OF THE INVENTION

It is, accordingly, an object of the present invention to provide improved methods and apparatus for supplying high-pressure fuel for use by a fuel utilization device which is reliable, efficient and inexpensive both to build and maintain.

It is a further object of the present invention to provide a high-pressure fuel pump which can achieve fuel-pressures in excess of 2,000 bar without being permanently lubricated and sealed.

It is yet another object of the present invention to provide a fuel-pressure intensifying sub-assembly for use with a known pump sub-assembly to thereby form a fuel pump which is capable of reliably and inexpensively supplying fuel at pressures in excess of 2,000 bar.

These and other objects and advantages of the present invention are provided in one apparatus embodiment by a fuel-pressure intensifier sub-assembly for use with conventional fuel pump components.

Another variation of the present invention entails a complete high-pressure fuel pump for receiving fuel from a fuel source and delivering fuel to a fuel utilization device, the fuel pump incorporating an intensifier assembly. For the sake of brevity, the pump embodiment and the intensifier sub-assembly embodiment of the present invention will generally be discussed below as a single apparatus embodiment. It will be appreciated, however, that these are distinct aspects of the same invention.

The fuel pump of the present invention preferably includes an intensifier sub-assembly, a pump body defining a cam box, a rotary drive shaft with at least one cam attached thereto and disposed within the cam box for driving the intensifier sub-assembly in alternating fuel-intake and fuel-pumping phases of operation. Moreover, the pump preferably also has at least one low-pressure fuel supply and at least one cam follower assembly disposed within the cam box and driven by the cam.

The intensifier sub-assembly preferably includes a sub-assembly body, a fuel pre-metering device, a poppet-valve assembly, at least one low-pressure pumping plunger, an intensifier piston, a piston-bias member and a high-pressure pumping plunger. The intensifier sub-assembly body defines at least one low-pressure bore, a metered fuel circuit, at least one intensifier bore fluidly connected to the low-pressure bore and in selective fluid communication with the metered fuel circuit. This body further defines a poppet-valve bore, at least one high-pressure bore in selective fluid communication with the metered fuel circuit via the poppet-valve assembly and an outlet port in selective fluid communication with the high-pressure bore via the poppet-valve assembly.

The pre-metering device preferably receives fuel from the fuel supply and delivers metered low-pressure fuel to the metered fuel circuit. The poppet-valve assembly is movably disposed within the poppet-valve bore for permitting selective fluid communication between the metered fuel circuit and the high-pressure bore. The poppet-valve assembly preferably also permits selective fluid communication between the high-pressure bore and the outlet port whereby low-pressure fuel may enter the high-pressure bore during the in-take phase of operation and whereby high-pressure fuel may exit this bore during the pumping phase of operation.

Each of the low-pressure pumping plungers is movably disposed within one of the low-pressure bores and driven by one of the cam follower assemblies such that fuel is delivered into the low-pressure bore during the in-take phase of operation and pressurized and pumped into the intensifier bore during the pumping phase of operation. The low-pressure pumping plungers present an aggregate surface area toward the intensifier bore.

The intensifier piston is movably disposed within the intensifier bore and driven in a first direction by pressurized fuel displaced from the low-pressure bore during the pumping phase of operation. The piston is biased by a piston-bias member in a second direction which is opposite to the first direction so that the piston returns to its initial position during the in-take phase of operation. The intensifier piston presents a surface area which faces the low-pressure pumping plungers.

The high-pressure pumping plunger is movably disposed within at least one of the high-pressure bore and the intensifier bore and presents a surface area toward the outlet port. The high-pressure pumping plunger is driven by the intensifier piston such that fuel is transferred into the high-pressure pumping plunger bore via the poppet-valve assembly during the in-take phase of operation and such that fuel is pressurized and pumped into the outlet port via the poppet-valve assembly during the pumping phase of operation.

By judiciously selecting the surface areas of the intensifier piston and the high-pressure pumping plunger, it is possible to select the fuel-pressure generated by the inventive fuel pump. This pressure differs from the pressure generated by the low-pressure pumping plungers alone by an amount which is equal to the ratio of the surface area of the intensifier piston to the surface area of the high-pressure pumping plunger. This can be done by selecting the diameter of the intensifier piston utilized in the pump. Significantly, it is not only possible to increase the fuel-pressure of a pump in this manner, it is also possible to intensify the fuel flow from, and reduce the fuel-pressure of, such a pump by properly selecting the size and/or the number of components of the pump. In such a case, the intensifier sub-assembly actually functions as a fuel-pressure conversion-assembly and the low and high pressures can be thought of as simply first and second pressures. Such a fuel-flow intensification pump may have limited utility in certain specialized applications. It will be appreciated, however, that the primary objective of the present invention is to generate still higher fuel pressures than, as a practical matter, have heretofore been possible.

Yet another embodiment of the present invention is a method of producing intensified high-pressure fuel from a pump of the type having a fuel metering device, a plurality of low-pressure bores with low-pressure plungers disposed therein, an intensifier bore with a piston disposed therein, a resilient bias member acting on the piston, a high-pressure bore with a high-pressure plunger at least partially disposed therein and a fuel outlet port wherein the pump operates in alternating fuel-in-take and fuel- pumping phases of operation.

The method comprises transferring a metered charge of fuel into the high-pressure bore during the in-take phase of operation. Additionally, fuel is transferred into the low-pressure bore during the intake phase of operation and the piston is permitted to move into a bottom dead center position within the intensifier bore. This action urges fuel from the intensifier bore into the low-pressure bores to thereby urge the low-pressure plungers into a bottom dead center position. Finally, fluid communication into the low-pressure bores is established such that metered fuel may enter the low-pressure bores.

During the pumping phase of operation, the method entails moving the low-pressure plungers from the bottom dead center position to the top dead center position whereby fuel from the low-pressure bores is displaced into the intensifier bore. This action terminates fluid communication into the low-pressure bores. Moreover, the piston is urged into a top dead center position by the displaced fuel and the high-pressure plunger is urged into a top dead center position by contact with the intensifier piston. Finally, the metered fuel charge is pressurized and transferred from the high-pressure bore to the pump outlet port for use by the fuel utilization device.

BRIEF DESCRIPTION OF THE DRAWINGS

The preferred embodiments of the present invention will be described below with reference to the accompanying drawings wherein like numerals represent like structures and wherein.

FIG. **6*a* is a cross-sectional side elevational view of the poppet-valve assembly of the present invention wherein the pump is shown in the fuel-in-take phase of operation.

DESCRIPTION OF THE PREFERRED EMBODIMENTS

The preferred intensified high-pressure fuel pump of the present invention will now be described with joint reference to FIGS. 1–6*b* and, in particular, with emphasized reference to FIGS. 1 and 2.

Figure 1:
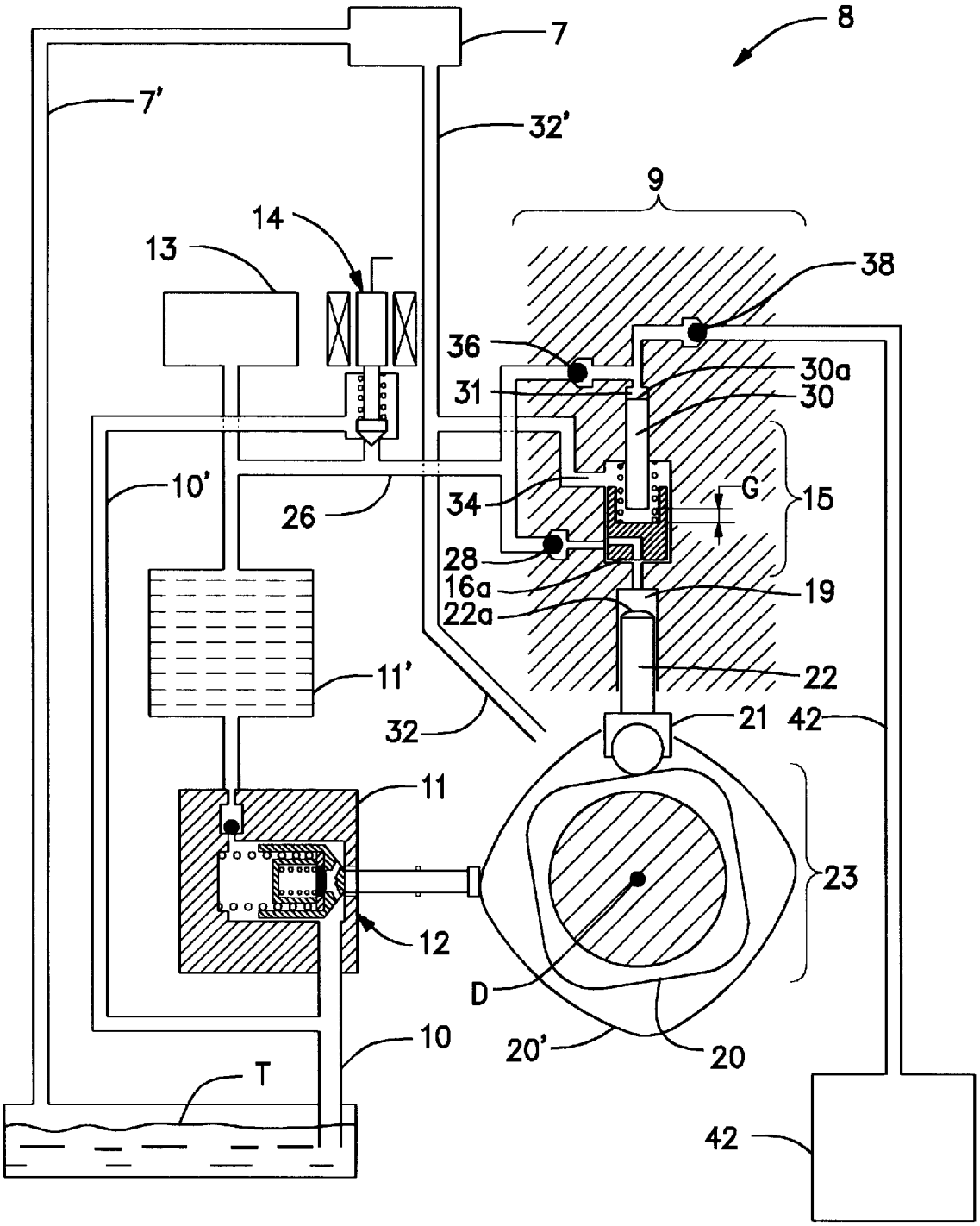
FIG. 1 is a schematic representation of an intensified high-pressure fuel pump in accordance with one embodiment of the present invention.
Figure 2:
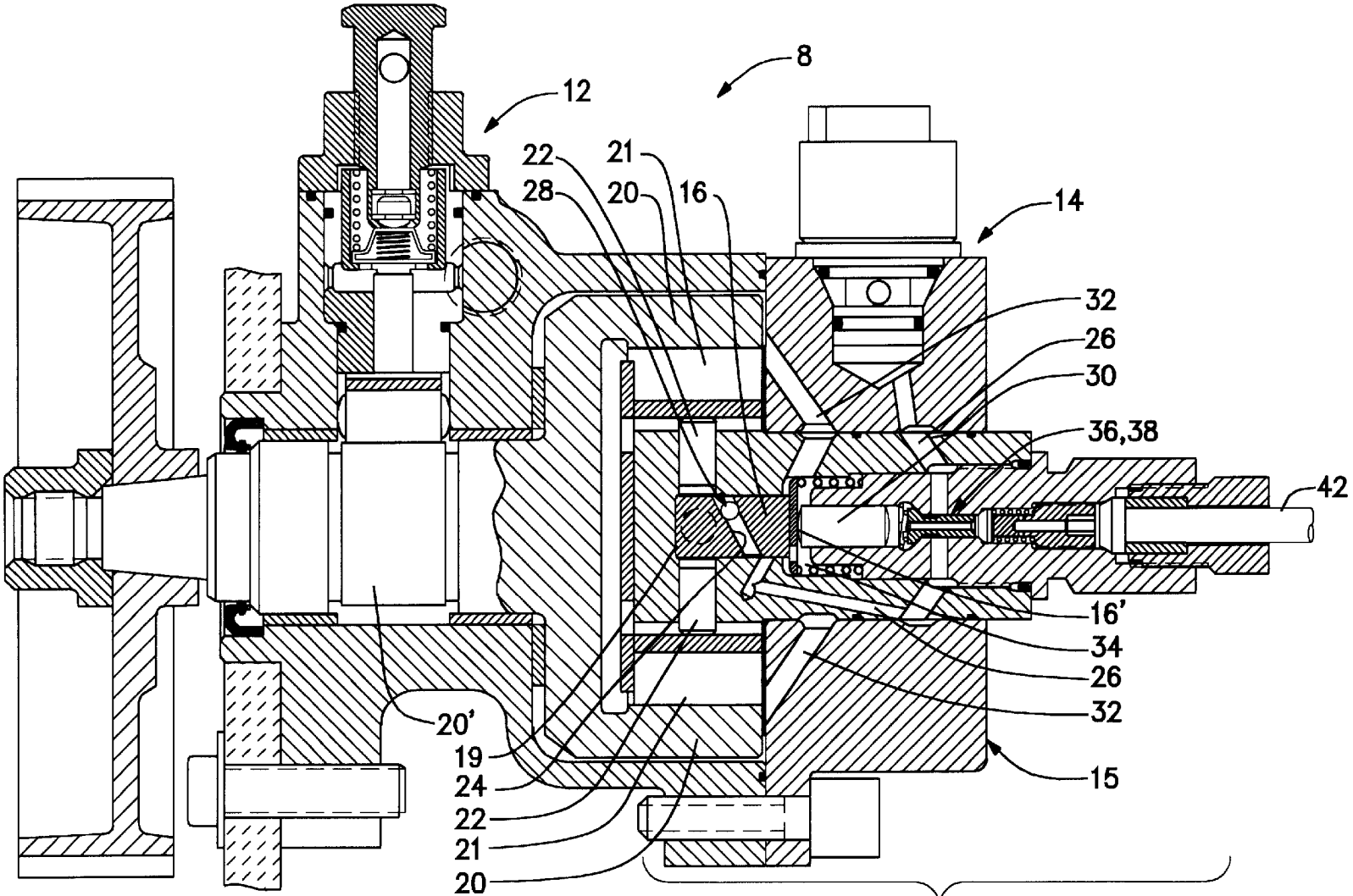
FIG. 2 is a cross-sectional side elevation view of an intensified high-pressure fuel pump in accordance with a preferred embodiment of the present invention.

FIG. 1 shows a schematic representation of an intensified high-pressure fuel pump 8 in accordance with the present invention. As shown therein, pump 8 generally includes a fuel supply 12, a cam box 23 having a plurality of components disposed therein and a fuel-pressure intensifier sub-assembly 9. As shown, sub-assembly 9 is fluidly connected to fuel supply 12 at one end thereof and fluidly connected to an external fuel utilization device 42 at an opposite end thereof. In this case, fuel utilization device 42 is a high-pressure fuel accumulator of a common-rail fuel supply system.

Fuel supply 12 is preferably comprised of a fuel supply line 10, a pump 11 which is actuated by components within cam box 23, a fuel filter 11', a low-pressure fuel accumulator 13, a solenoid-activated fuel pre-metering device 14 and a fuel recirculating passage 10'.

Those of ordinary skill will readily appreciate that fuel supply 12 consists of conventional components operating in a conventional manner. In particular, fuel from a fuel tank T is delivered through passage 10 and fuel filter 11' by pump 11 so that low-pressure fuel accumulates in accumulator 13. Fuel supplied thereby is delivered to a metered fuel circuit 26 of the intensifier sub-assembly 9. Fuel metering device 14 is connected to metered fuel circuit 26 in order to regulate the fuel-pressure therein by permitting regulated feedback of pressurized fuel through passage 10'.

Intensified high-pressure fuel pump 8 further includes a pump body which defines cam box 23 and an axially extending drive shaft D having first and second cams 20 and 20' disposed within cam box 23. Naturally, drive shaft D is rotated when in use such that second cam 20' drives pump 11 as shown in FIG. 1. Similarly, the rotation of drive shaft D causes cyclic engagement between first cam 20 and cam follower assemblies 21 to thereby provide alternating fuel-in-take and fuel-pumping phases of operation of pump 8 and of intensifier sub-assembly 9. Although the schematic illustration of FIG. 1 only shows a single cam follower (with an associated low-pressure bore 19 and a pumping plunger 22) the present invention includes embodiments utilizing a plurality of cam followers, each with associated pumping plungers. In particular, the embodiment illustrated in FIGS. 2 et seq utilize four cam followers 21 with associated low-pressure pumping plungers 22, three of which (one in phantom) can be clearly seen in FIGS. 2–5.

High-pressure accumulator 42 is fluidly connected with, and downstream of, intensifier sub-assembly 9. In the preferred apparatus embodiments of the present invention, high-pressure accumulator 42 is also fluidly connected to a common-rail (not shown) of a common-rail fuel supply system. Naturally, this means that accumulator 42 is connected to a common-rail which is, in turn, connected to a plurality of individual fuel injectors (not shown). However, those of ordinary skill will readily appreciate that the preferred apparatus embodiments shown and described herein can be readily modified to supply fuel directly to other fuel utilization devices such as fuel injectors.

Also schematically shown in FIG. 1 is an overflow vessel 7 fluidly connected to intensifier sub-assembly via passage 32. Vessel 7 is located in an upper portion of pump 8 and also fluidly connected to fuel tank T via passage 7'. As will be described in greater detail below, vessel 7 permits air, fuel vapor and excess leakage fuel to be recirculated back to fuel tank T.

The various features of fuel-pressure intensifier sub-assembly 9 are shown in greater detail in FIGS. 3–6*b*. As shown therein, fuel-pressure intensifier sub-assembly 9 preferably includes a sub-assembly body 15, at least one low-pressure pumping plunger 22, an intensifier piston 16, a resilient bias member 18, a high-pressure pumping plunger 30 and a plurality of check valves 28, 36 and 38.

Focusing first on sub-assembly body 15, those of ordinary skill will appreciate that body 15 defines a plurality of passages and pumping-plunger bores. In particular, body 15 preferably defines low-pressure bores 19, an intensifier piston bore 34, a high-pressure bore 31, a metered fuel circuit 26, lubricating-fuel/fuel-venting passages 32 and 32' and a poppet-valve assembly bore 42 (see especially FIGS. 6*a* and 6*b*).

Intensifier sub-assembly 9 also includes low-pressure pumping plungers 22 with surface areas 22*a* at respective first ends thereof facing the intensifier bore. As shown, plungers 22 are preferably disposed for linear reciprocal movement within low-pressure bores 19. Such movement includes movement in a first direction (toward the intensifier bore 34) under the influence of cam 20 and cam followers 21. Movement of plungers 22 in a second direction, which is opposite to the first direction, occurs under the influence of fuel displaced from piston bore 34 during the fuel-in-take phase of operation. As shown in the various figures, low-pressure bores 19 are fluidly connected to piston bore 34 such that fuel is cyclically transferred between bores 19 and 34 during respective in-take and pumping phases of operation.

In the preferred apparatus embodiments of the present invention, sub-assembly body 15 also defines the lubricating-fuel/fuel-venting passages 32 and 32' extending between piston bore 34, cam box 23 and overflow vessel 7.

Intensifier piston 16 and resilient bias member 18 are disposed within piston bore 34 for linear reciprocal movement during operation of the pump. While piston 16 is urged in the first direction by fuel displaced from low-pressure bores 19 during the pumping phase of operation, the bias member 18 urges intensifier piston 16 in the opposite direction during the in-take phase of operation such that fuel from piston bore 34 is transferred back into low-pressure bore 19. It will be understood that the particular style and biasing force of resilient bias member 18 will be dictated by the forces acting on and in the vicinity of member 18. In particular, member 18 should apply sufficient returning force to piston 16 during the in-take phase while not overly inhibiting motion of piston 16 during the pumping phase. The end of intensifier piston 16 which is opposite to bias member 18 is slightly rounded (see FIGS. 3–5) and presents surface area 16*a*. This arrangement induces movement of piston 16 under the influence of fuel urged out of low-pressure bores 19 and into piston bore 34.

Similarly, fuel is cyclically transferred between piston bore 34 and cam box 23 via passage 32. Thus, during the pumping phase of operation, movement of intensifier piston 16 urges leakage fuel from bore 34, through passage 32 and into cam box 23 where this fuel serves to lubricate the various components within cam box 23. During the in-take phase of operation, this lubricating-fuel is drawn from cam box 23, through passage 32 and back into piston bore 34 by the movement of piston 16 in the second direction. Naturally, repeated lubrication of cam box 23 is achieved in synchronism with the in-take and pumping phases of operation. The above-noted lubricating-fuel arrives in piston bore 34 as fuel which has leaked around intensifier piston 16 and high-pressure pumping plunger 30 during normal operation of the pump. Restated, the lubricating-fuel is fuel which has seeped into piston bore 34 from between bores 19 and 31 and the respective plungers disposed therein. Thus, once the pump has been used for the first time in a while, the various components contained within cam box 23 remain well lubricated. In addition, venting of excess lubricating fuel, etc. to tank T is necessary for cooling. This is preferably accomplished with a fuel-venting passage 32' extending into vessel 7 and with fuel return passage 7' fluidly connecting vessel 7 and tank T.

In the preferred apparatus embodiments of the present invention, intensifier piston 16 is provided with a passage 24 which is in selective fluid communication with metered fuel circuit 26 and in constant fluid communication with plunger bore 19. Selective communication between metered fuel circuit 26 and passage 24 is, in part, achieved by check valve 28. Check valve 28 can be located either within metered fuel circuit 26 or within passage 24 of piston 16 as shown in the various figures. During at least a portion of the in-take phase of operation, and particularly when piston 16 reaches its bottom dead center position, fuel is permitted to flow through check valve 28, through passage 24 and into bore 19. This fuel replaces any fuel which may have leaked past intensifier piston 16 and low-pressure plungers 22 during previous pumping phases of operation. Thus, this aspect of the present invention ensures that sufficient fuel is maintained between plungers 22 and piston 16 regardless of any fuel leakage which may occur.

Figure 3:
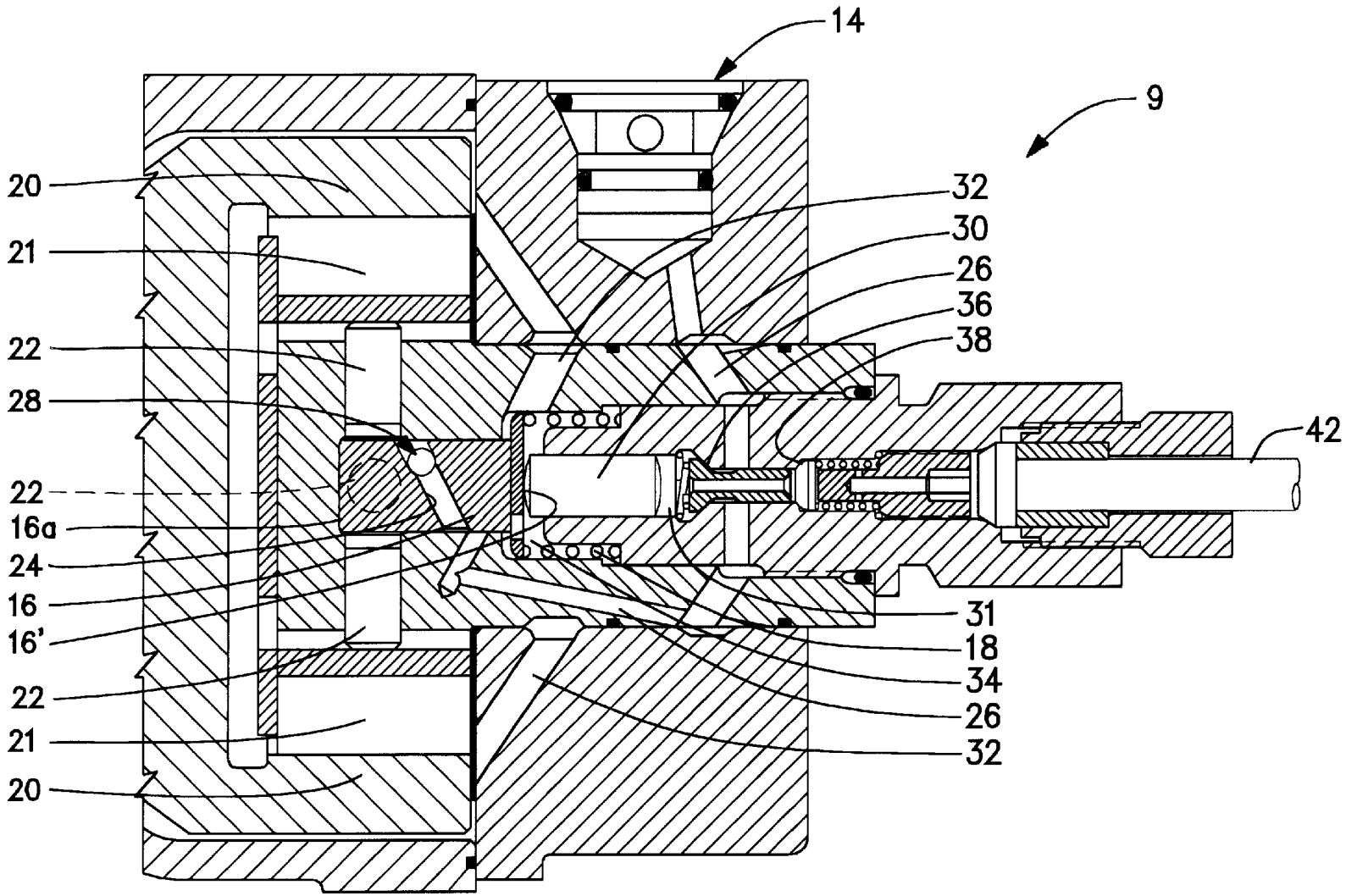
FIG. 3 is a cross-sectional side elevation view of a portion of the pump of FIG. 2 wherein the low-pressure pumping plungers, the intensifier piston and the high-pressure plunger are shown in the bottom dead center position.
Figure 4:
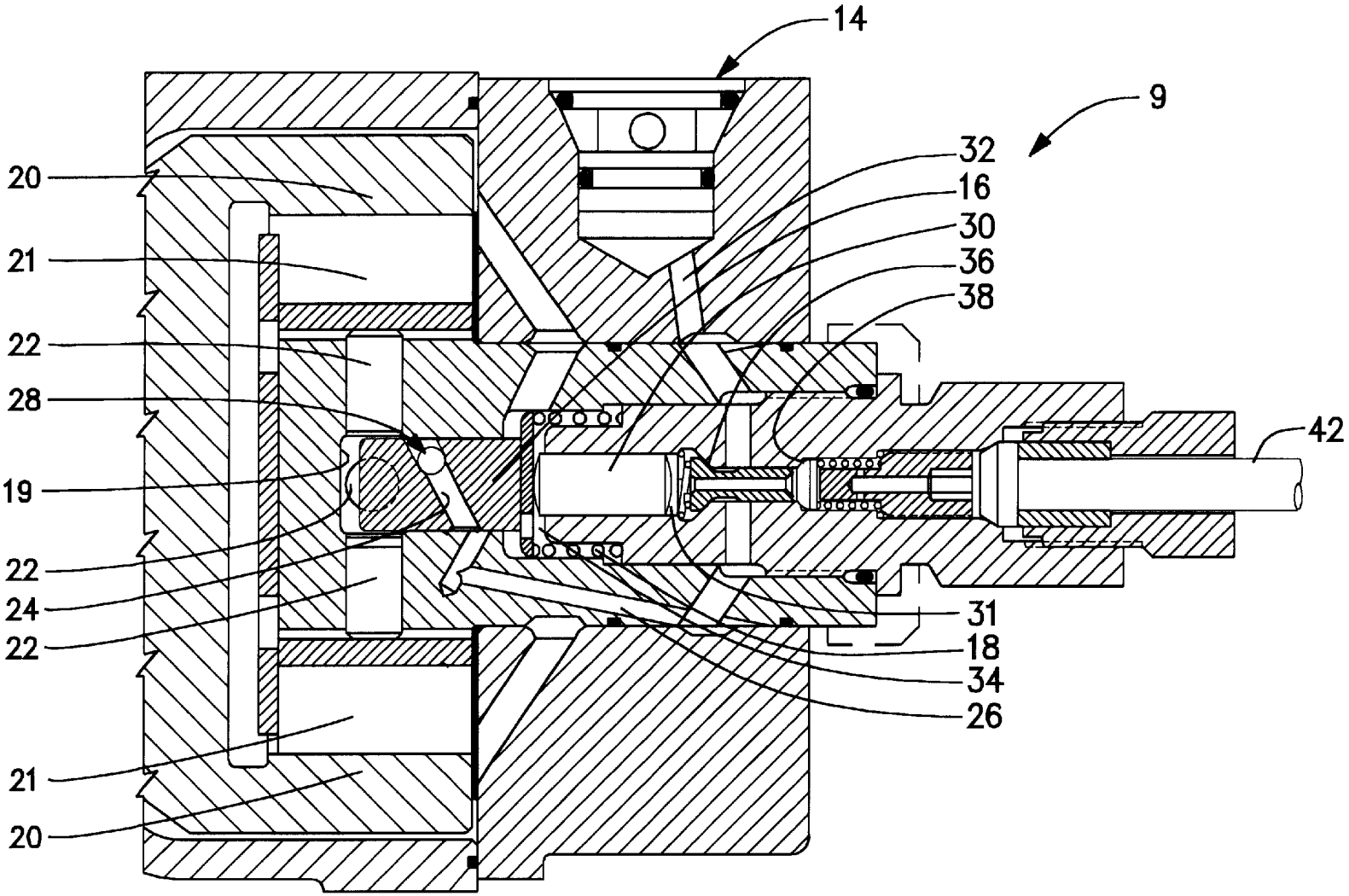
FIG. 4 is a cross-sectional side elevation view of a portion of the pump of FIG. 2 wherein the low-pressure plungers, the intensifier piston and the high-pressure plunger are shown in an intermediate position.
Figure 5:
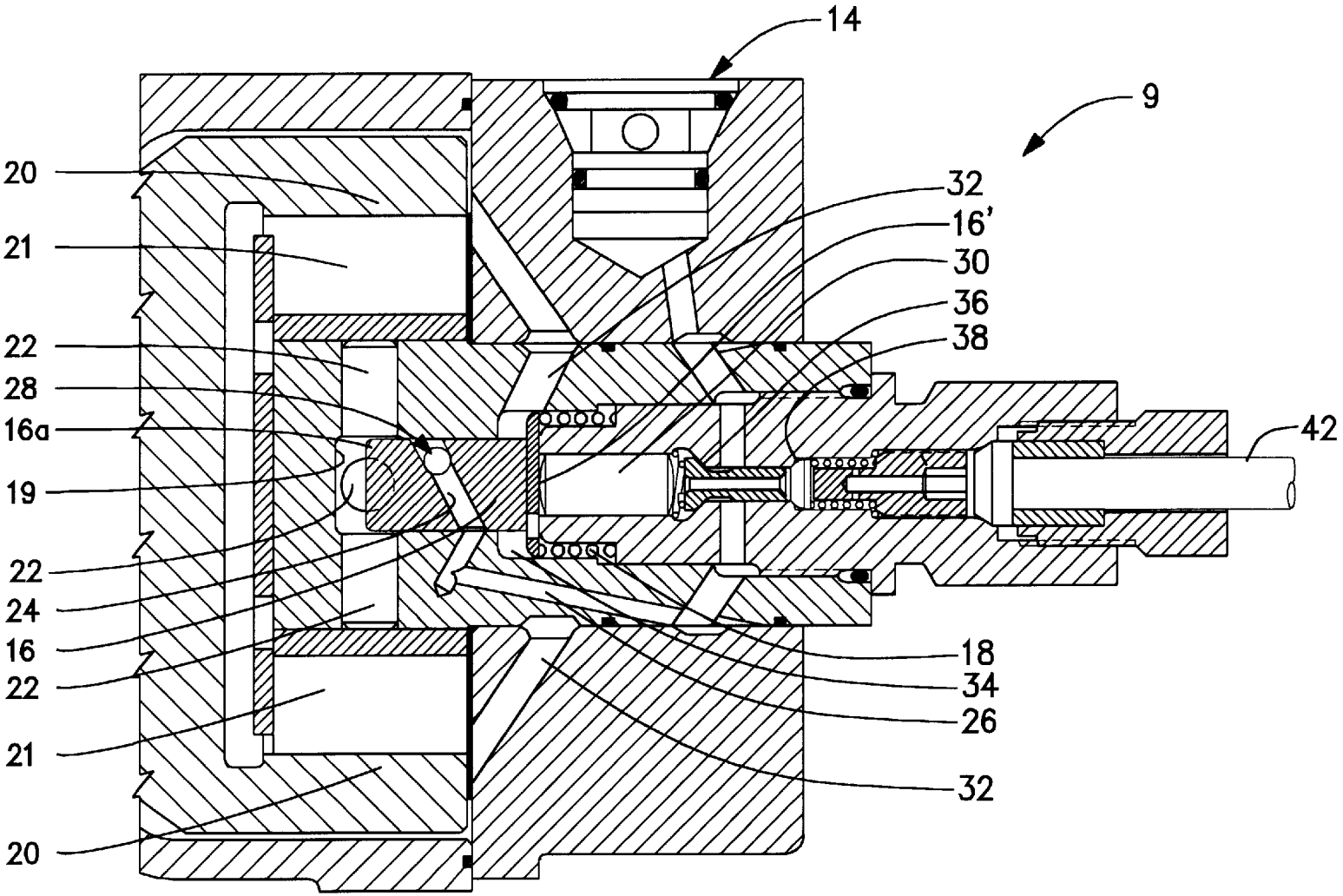
FIG. 5 is a cross-sectional side elevation view of a portion of the pump of FIG. 2 wherein the low-pressure plungers, the intensifier piston and the high-pressure plunger are shown in the top dead center position.

A high-pressure pumping plunger 30 is preferably disposed for linear reciprocal movement within both of high-pressure bore 31 and intensifier bore 34. During the in-take phase of operation, plunger 30 is pushed by the fuel entering the high-pressure bore 31 and is drawn in the second direction during movement of piston 16 over a distance which depends upon the pressure of the fuel disposed within metered fuel circuit 26 (see gap G in FIG. 1). In particular, high-pressure bore 31 is filled with fuel from fuel supply 12 via metered fuel circuit 26 and inlet check valve 36. If it is desired to transfer a sizeable fuel charge into high-pressure bore 31, pre-metering device 14 is controlled to increase the pressure in metered fuel circuit 26 whereby a sizeable quantity of fuel will flow through check valve 36 and into high-pressure bore 31. In this case, gap G (FIG. 1) will be eliminated so that plunger 30 contacts intensifier piston 16 at the end of the in-take phase of operation. Thus, high-pressure plunger 30 is in a bottom dead center position as shown in FIG. 3. When the pumping phase of operation commences, plunger 30 is urged in the first direction to an intermediate position (see FIG. 4) by movement of intensifier piston 16 whereby fuel disposed within high-pressure bore 31 begins to become pressurized and urged into high-pressure accumulator via outlet check valve 38. Plunger 30 eventually reaches the top dead center position shown in FIG. 5 when pressurization and pumping is maximized. As noted above, the pressure of the fuel passing through outlet check valve 38 is dictated by the ratio of the surface area 30*a* at one end of plunger 30 and the surface area of plunger 16.

If less fuel is demanded by the system, fuel metering device 14 reduces the fuel-pressure in metered fuel circuit 26 so that less fuel enters high-pressure bore 31. In this case, gap G (FIG. 1) will have a non-zero value but plunger 30 will traverse less than the full distance described above. In the limiting case, if it is desired to pump zero fuel to the high-pressure fuel accumulator 42, plunger 30 is maintained in its top dead center position by reducing fuel-pressure in metered fuel circuit 26 to a value which is below the opening pressure of inlet check valve 36.

Figure 6A:
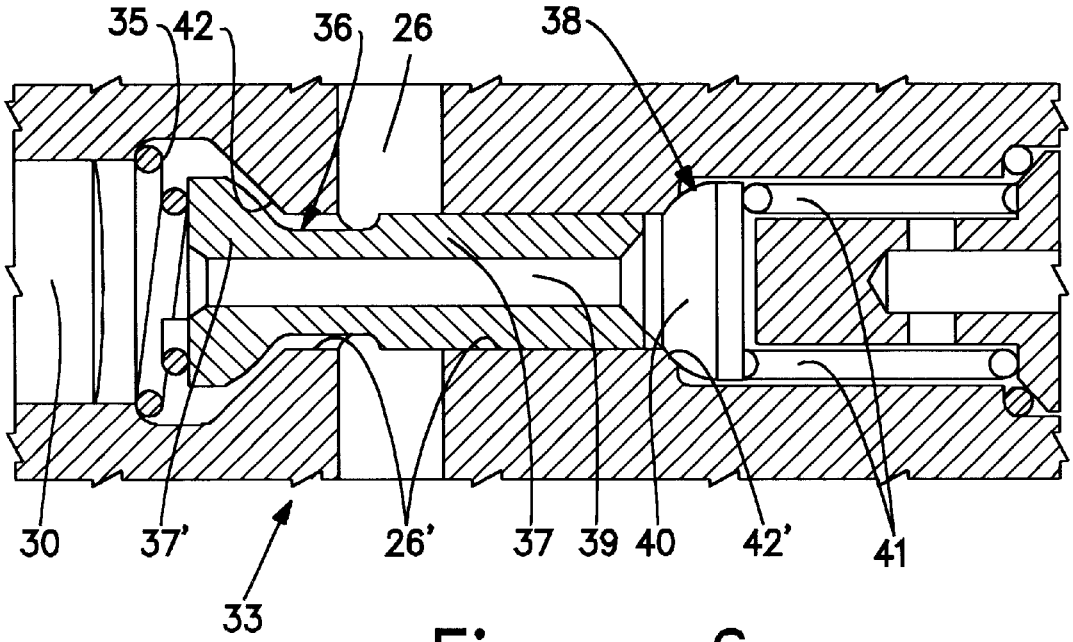
FIG. 6*b*** is a cross-sectional side elevational view of the poppet-valve assembly of the present invention wherein the pump is shown in the pumping phase of operation.
Figure 6B:
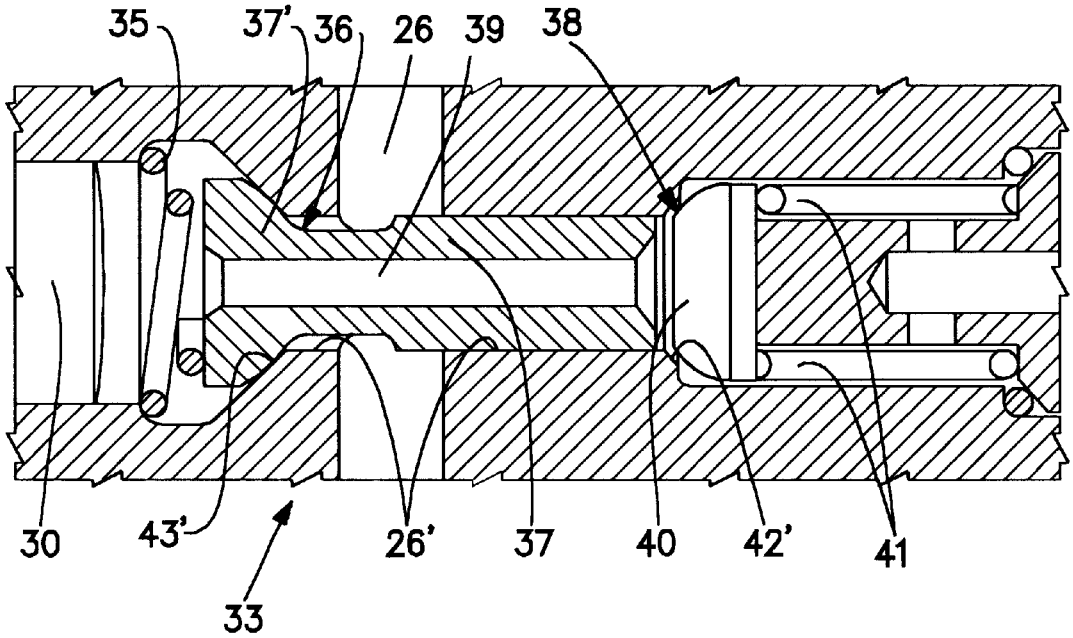

While check valves 36 and 38 could be independent check valves disposed within metered fuel circuit 26 of sub-assembly body 15, they are both preferably included in the single poppet-valve assembly 33 shown in detail in FIGS. 6*a* and 6*b*. This arrangement minimizes the trapped dead volume. As shown therein, poppet-valve assembly 33 preferably includes an elongated shaft 37 movably disposed within a poppet-valve assembly bore 26'. Shaft 37 preferably includes a linear fluid passage 39 extending therethrough as well as an enlarged end 37' which is capable of sealingly engaging a first valve seat 42 of valve assembly bore 26'. Assembly 33 also preferably includes a first resilient bias member 35 for resiliently urging enlarged end 37' of shaft 37 into sealing engagement with the first valve seat 42. Moreover, assembly 33 also preferably includes an enlarged button 40 movably disposed within valve assembly bore 26', button 40 being capable of sealingly engaging a second valve seat 42' of valve assembly bore 26'. Finally, poppet-valve assembly 33 also preferably includes a second resilient bias member 41 for resiliently urging enlarged button 40 into sealing engagement with the second valve seat 42', as discussed above. Those of ordinary skill will readily appreciate that the particular style and biasing force of resilient bias members 35 and 41 will be dictated by the size of the various components of poppet-valve assembly 33 and the pressures at which check valves 36 and 38 need to be opened. One clear advantage of utilizing the poppet-valve assembly of FIG. 6*a* and 6*b* is that during the fuel-pumping phase of operation, only the unbalanced portion of the force created by the fuel-pressure will act on the first valve seat 42 and member 37'. Accordingly, the Hertzian stresses at this interface will be strongly reduced resulting in a concomitant reduction in the possibility of component failure.

The amount by which fuel-pressure can be intensified utilizing the apparatus of the present invention will be determined, at least in large part, by the ratio of the intensifier piston surface area 16*a* to that of the high-pressure plunger surface area 30*a*. The intensification ratio of the preferred apparatus embodiments is theoretically 4:1 and the pressure of the fuel exiting outlet check valve 38 is in the range of 4,000 bar. As noted above, various other intensification factors can be achieved by changing the various component sizes and by changing the number of components utilized.

A number of variations of the preferred embodiment are possible. For example, passage 24 extending through intensifier piston 16 could be entirely eliminated if metered fuel circuit 26 were directly connected to low-pressure bore 19 via check valve 32. Moreover, close inspection of intensifier piston 16 of the preferred embodiment (see FIGS. 2–5) reveals that there is an end plate 16' fixedly attached at one end thereof. Plate 16' serves as a bearing surface for bias member 18 for the particular configuration of the preferred embodiment. However, it is possible, although less desirable, to integrally form intensifier piston 16 and end plate 16'. Additionally, end plate 16' may have one or more apertures extending therethrough to permit the free flow of fuel therethrough as piston 16 moves through bore 34. These apertures allow less restrictive motion of the plate to thereby increase performance of the invention by shortening the response time of the various components during the in-take and pumping phases of operation. Yet another optional feature of the present invention is to integrally form piston 16 and plunger 30. However, the configuration of the preferred embodiments is advantageous in that separating the piston and the plunger improves manufacturing tolerances and permits partial filling of the high-pressure chamber without cavitation.

The preferred method of using the intensified high-pressure fuel pump of the present invention will be described below. First, a metered charge of fuel is transferred from metered fuel circuit 26 into high-pressure bore 31 during the in-take phase of operation of the pump. Also during the in-take phase, fuel is transferred from metered fuel circuit 26 into low-pressure bores 19. Moreover, resilient bias member 18 is permitted to urge intensifier piston 16 into a bottom dead center position within intensifier bore 34 during the in-take phase. This action displaces fuel from intensifier bore 34 into low-pressure bores 19 which, in turn, urges low-pressure plungers 22 in a bottom dead center direction (i.e., the second direction). Finally, during the in-take phase, fluid communication is established between low-pressure bores 19 and metered fuel circuit 26 such that pre-metered fuel may enter low-pressure bores 19 to replace any fuel which may have leaked therefrom during a previous pumping phase of operation.

After the in-take phase of operation has been completed, the pumping phase will commence. During this phase, low-pressure plungers 22 are moved from the bottom dead center position to a top dead center position (FIG. 5) whereby fuel from low-pressure bores 19 is pressurized and displaced into intensifier bore 34 and fluid communication between low-pressure bores 19 and metered fuel circuit 26 ceases. Moreover, intensifier piston 16 is urged into a top dead center position by the pressurized and displaced fuel and high-pressure pumping plunger 30 is urged into a top dead center position by contact with intensifier piston 16. This action, in turn, pressurizes and transfers fuel from high-pressure bore 30 to the pump outlet port for use by the fuel utilization device 42.

In an especially preferred method embodiment, the step of moving may further comprise displacing fuel from intensifier piston bore 34 into cam box 23 of pump 8 during the pumping phase of operation. Naturally, this action lubricates the pump components disposed within cam box 23. Further, the step of moving may further comprise venting fuel from the intensifier piston bore 34 back to the fuel supply. Additionally, the step of urging may further comprise drawing fuel from cam box 23 back into intensifier piston bore 34 during the in-take phase of operation.

While the present invention has been described in connection with what is presently considered to be the most practical and preferred embodiments, it is to be understood that the invention is not limited to the disclosed embodiments, but is intended to cover the various modifications and equivalent arrangements included within the spirit and scope of the appended claims.

What is claimed is:

1. A fuel pump for receiving fuel from an external fuel source and discharging fuel for use by a fuel utilization device, said pump comprising:

a fuel-delivery device fluidly connected to the external fuel source for receiving fuel therefrom and delivering the fuel to said fuel pump;

a pump body defining a cam box;

a rotary drive shaft having at least one cam attached thereto and disposed within said cam box;

at least one reciprocating cam follower assembly which is disposed within said cam box and driven by said cam to provide alternating fuel-in-take and fuel-pumping phases of operation of said pump; and a fuel-pressure conversion-assembly comprising, a conversion-assembly body which defines at least one first-pressure bore, a fuel circuit fluidly connected to said fuel-delivery device to receive fuel therefrom, at least one piston bore fluidly connected to said first-pressure bore, at least one second-pressure bore in selective fluid communication with said fuel circuit and an outlet port in selective fluid communication with said second-pressure bore;

at least one first-pressure pumping plunger, each of said plungers being movably disposed within one of said first-pressure bores and being driven by one of said cam follower assemblies whereby fuel is delivered into said first-pressure bore during said in-take phase of operation and pumped therefrom into said piston bore during said pumping phase of operation;

a converting piston disposed for reciprocal motion within said piston bore such that said piston is driven by fuel in a first direction during said pumping phase of operation in synchronism with said first-pressure plunger;

a second-pressure pumping plunger movably disposed within said at least one second-pressure bore, said second-pressure plunger being driven in said first direction and in a second opposite direction under the influence of said piston during said pumping and in-take phases of operation respectively;

a resilient bias member to urge said piston in said second direction such that said piston moves in said second direction during said in-take phase of operation in synchronism with said first-pressure pumping plunger;

an inlet check valve for preventing the flow of fuel from said second-pressure bore into said fuel circuit device during said pumping phase of operation and for permitting the flow of fuel into said second-pressure bore during said in-take phase of operation;

an outlet port fluidly connected to said second-pressure bore for discharging fuel for use by the fuel utilization device; and an outlet check valve for preventing the flow of fuel into said second-pressure bore from said outlet port and for permitting the flow of fuel from said second-pressure bore into said outlet port during said pumping phase of operation.

2. The pump of claim 1 wherein said converting piston includes a first surface area facing said second direction;

said second-pressure pumping plunger includes a second surface area facing said first direction; and said first surface area is greater than said second surface area whereby the fuel discharged from said second-pressure bore is at a higher pressure than the fuel within said piston bore.

3. The pump of claim 2 wherein said fuel circuit includes a passage fluidly connected to said piston bore; and said piston includes a passage extending therethrough, said piston passage permitting fuel to pass from said fuel circuit to said first-pressure bore during said in-take phase of operation, said piston passage having a check valve for preventing fuel from flowing from said piston passage into said fuel circuit.

4. The pump of claim 3 wherein said fuel circuit passage and said piston passage are only in fluid communication with one another during a portion of said in-take and pumping phases of operation.

5. The pump of claim 1 wherein said pump further comprises a lubricating-fuel passage extending between said piston bore and said cam box such that fuel from said piston bore passes to said cam box for lubrication during said pumping phase of operation and such that fuel from said cam box passes to said piston bore during said in-take phase of operation.

6. The pump of claim 1 wherein said inlet and outlet check valves comprise a poppet-valve assembly disposed within a valve assembly bore which is in selective fluid communication with said fuel circuit, said second-pressure bore and said outlet port, said bore having first and second valve seats, said poppet-valve assembly comprising:

an elongated shaft movably disposed within said valve assembly bore, said shaft having a fluid passage extending therethrough and an enlarged end which is capable of sealingly engaging said first valve seat;

a first resilient bias member for resiliently urging said enlarged end of said shaft into sealing engagement with said first valve seat;

an enlarged button movably disposed within said valve assembly bore and capable of sealingly engaging said second valve seat of said valve assembly bore; and a second resilient bias member for resiliently urging said enlarged button into sealing engagement with said second valve seat.

7. The pump of claim 1 wherein said piston and said second-pressure pumping plunger are each substantially cylindrical members which are axially aligned with one another; and said resilient bias member is a coil spring disposed in axial alignment with said piston.

8. The pump of claim 1 further comprising a lubricating-fuel passage fluidly connecting said piston bore and said cam box whereby fuel disposed within said piston bore is transferred into said cam box during said pumping phase of operation and fuel disposed within said cam box is transferred therefrom into said piston bore during said in-take phase of operation.

9. The pump of claim 1 wherein said inlet and outlet check valves comprise a poppet-valve assembly disposed within a valve assembly bore which is in selective fluid communication with said fuel circuit, said second-pressure bore and said outlet port.

10. A method of receiving low-pressure fuel from a fuel source and of producing intensified high-pressure fuel from a pump of the type having a plurality of low-pressure bores with respective low-pressure pumping plungers movably disposed therein, an intensifier bore with an intensifier piston movably disposed therein and a high-pressure bore with a high-pressure pumping plunger movably disposed therein, the pump operating in alternating fuel-in-take and fuel-pumping phases of operation, said method comprising:

transferring fuel into the low-pressure and high-pressure bores during the in-take phase of operation;

transferring fuel from the low-pressure bores into the intensifier bore during the pumping phase of operation;

urging the intensifier piston into a bottom dead center position within the intensifier bore during the in-take phase of operation whereby fuel is displaced from the intensifier bore into the low-pressure bores, the low-pressure plungers are urged into a bottom dead center position by the displaced fuel and fuel is permitted to enter the low-pressure bores; and moving the low-pressure plungers from the bottom dead center position to a top dead center position during the pumping phase of operation whereby fuel from the low-pressure bores is displaced into the intensifier bore, urging the intensifier piston into a top dead center position, and the high-pressure pumping plungers are urged into a top dead center position such that the fuel within the high-pressure bore is pressurized and discharged from the high-pressure bore for subsequent use.

11. The method of claim 10 wherein said step of moving further comprises displacing leakage fuel from the intensifier bore into a cam box of the pump during the pumping phase of operation whereby pump components disposed within the cam box are lubricated by the leakage fuel;

said step of moving further comprises venting fuel from the intensifier bore to the fuel source during the pumping phase of operation; and said step of urging further comprises drawing leakage fuel from the cam box into the intensifier bore during the in-take phase of operation.

12. The method of claim 10 further comprising the steps of:

lubricating a cam box of the pump by transferring leakage fuel from the intensifier bore during the pumping phase of operation;

transferring leakage fuel from the cam box to the intensifier bore during the in-take phase of operation; and venting fuel from the intensifier fuel to the fuel source during the pumping phase of operation.

13. The method of claim 10 further comprising:

pre-metering the fuel transferred into the low-pressure and high-pressure bores during the in-take phase of operation; and pre-metering the fuel permitted to enter the low-pressure bores during the in-take phase of operation.

14. A fuel-pressure intensifier assembly for use with a fuel pump sub-assembly of the type having a pump body defining a cam box, a rotary drive shaft with at least one cam attached thereto and disposed within the cam box for driving the intensifier assembly in alternating fuel-intake and fuel-pumping phases of operation, at least one low-pressure fuel supply, at least one cam follower assembly disposed within the cam box and driven by the cam, said intensifier assembly comprising:

a body which defines at least one low-pressure bore, a metered fuel circuit, at least one intensifier bore fluidly connected to said low-pressure bore and selectively fluidly connected to said metered fuel circuit, a poppet-valve assembly bore, at least one high-pressure bore in selective fluid communication with said metered fuel circuit via said poppet-valve bore and an outlet port in selective fluid communication with said high-pressure bore via said poppet-valve bore;

a fuel pre-metering device for receiving fuel from the low-pressure fuel supply and delivering metered low-pressure fuel to said metered fuel circuit;

a poppet-valve assembly movably disposed within said poppet-valve bore for permitting selective fluid communication between said metered fuel circuit and said high-pressure bore and between said high-pressure bore and said outlet port whereby low-pressure fuel may enter said high-pressure bore during said in-take phase of operation and whereby high-pressure fuel may exit said high-pressure bore during said pumping phase of operation;

at least one low-pressure pumping plunger, each of said plungers being movably disposed within one of said low-pressure bores and being driven by one of the cam follower assemblies whereby fuel is delivered into said low-pressure bore during said in-take phase of operation and pumped therefrom into said intensifier bore during said pumping phase of operation;

an intensifier piston movably disposed within said intensifier bore, said piston being driven in a first direction by fuel displaced from said low-pressure bore during said pumping phase of operation;

a piston-bias member for resiliently urging said piston in a second direction which is opposite to said first direction, said piston-bias member being disposed within said intensifier bore;

means for venting fuel from the intensifier piston to the fuel supply; and a high-pressure pumping plunger movably disposed within at least one of said high-pressure bore and said intensifier bore and presenting a surface area toward said outlet port, said high-pressure pumping plunger surface area being smaller than said low-pressure pumping plunger surface area, said high-pressure pumping plunger being driven by said intensifier piston such that fuel is transferred into said high-pressure pumping plunger bore via said poppet-valve assembly during said in-take phase of operation and such that fuel is pumped into said outlet port via said poppet-valve assembly during said pumping phase of operation.

15. The fuel-pressure intensifier assembly of claim 14 wherein said metered fuel circuit further comprises a lubricating-fuel passage fluidly connecting said intensifier bore and the cam box whereby lubricating-fuel from said intensifier bore is transferred into said cam box during said pumping phase of operation and lubricating-fuel from the cam box is transferred into said intensifier bore during said in-take phase of operation.

16. The fuel-pressure intensifier assembly of claim 14 wherein said body further defines a flow passage extending between said intensifier bore and said metered fuel circuit; and said intensifier piston includes a passage extending therethrough, said piston passage permitting fuel to pass from said fuel pre-metering device to said low-pressure bore during said in-take phase of operation, said piston passage having a check valve for preventing fuel from flowing from said piston passage into said metered fuel circuit.

17. The fuel-pressure intensifier assembly of claim 16 wherein said flow passage and said piston passage are only in fluid communication with one another during a portion of said in-take and pumping phases of operation.

18. The fuel-pressure intensifier assembly of claim 14 wherein said poppet-valve bore includes first and second valve seats; and said poppet-valve assembly comprises:

an elongated shaft movably disposed within said poppet-valve bore, said shaft having a fluid passage extending therethrough and an enlarged end which is capable of sealingly engaging said first valve seat;

a first resilient bias member for resiliently urging said enlarged end of said shaft into sealing engagement with said first valve seat;

an enlarged button movably disposed within said valve assembly bore and capable of sealingly engaging said second valve seat of said poppet-valve bore; and a second resilient bias member for resiliently urging said enlarged button into sealing engagement with said second valve seat.

19. The fuel-pressure intensifier assembly of claim 14 wherein said metered fuel circuit further comprises a valved passage extending into said low-pressure bore, said valved passage including a check valve for preventing fuel from flowing from said low-pressure bore into said metered fuel circuit.

20. The fuel-pressure intensifier assembly of claim 14 wherein said intensifier piston includes a first surface area facing said second direction;

said high-pressure pumping plunger includes a second surface area facing said first direction; and said first surface area is greater than said second surface area whereby the fuel discharged from said high-pressure bore is at a higher pressure than the fuel within said piston bore.

* * * * *